US008419172B2

(12) United States Patent
Koseki

(10) Patent No.: US 8,419,172 B2
(45) Date of Patent: Apr. 16, 2013

(54) LIQUID JET HEAD AND LIQUID JET APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 186 days.

(21) Appl. No.: 13/065,890

(22) Filed: Mar. 31, 2011

(65) Prior Publication Data

US 2011/0242223 A1 Oct. 6, 2011

(30) Foreign Application Priority Data

Apr. 1, 2010 (JP) ..... 2010-085450

(51) Int. Cl.
*B41J 2/045* (2006.01)

(52) U.S. Cl.
USPC ..... 347/68

(58) Field of Classification Search ..... 347/68–72
See application file for complete search history.

(56) References Cited

U.S. PATENT DOCUMENTS

| | | | | |
|---|---|---|---|---|
| 5,787,558 | A | 8/1998 | Murphy | 29/25.35 |
| 2002/0063766 | A1 | 5/2002 | Yoshizawa et al. | 347/100 |

FOREIGN PATENT DOCUMENTS

| | | |
|---|---|---|
| EP | 0647525 | 4/1995 |
| EP | 0768181 | 4/1997 |
| EP | 1470920 | 10/2004 |
| JP | 04307254 | 10/1992 |
| JP | 06270402 | 9/1994 |

OTHER PUBLICATIONS

Patent Abstracts of Japan, publication No. 09-029977, publication date Feb. 4, 1997.

Patent Abstracts of Japan, publication No. 2000-168094, publication date Jun. 20, 2000.

Patent Abstracts of Japan, publication No. 2002-210955, publication date Jul. 31, 2002.

*Primary Examiner* — Lamson Nguyen
(74) *Attorney, Agent, or Firm* — Adams & Wilks

(57) ABSTRACT

The liquid jet head (1) includes: a piezoelectric substrate (4) including a plurality of grooves (5) which are formed therein from a front end (FE) to a rear end (RE) of a surface of the substrate and separated from one another by side walls (3), the piezoelectric substrate having lead-out electrodes (8) formed on top surfaces of the side walls (3); a cover plate (11) which includes a manifold (9) and is bonded to the surface of the piezoelectric substrate (4); and a sealing material (14) for blocking, of channels formed by the cover plate (11) and the grooves (5), openings of rear channels (10) formed on the rear end (RE) side with respect to the manifold (9).

8 Claims, 8 Drawing Sheets

LIQUID JET HEAD AND LIQUID JET APPARATUS

TECHNICAL FIELD

The present invention relates to a liquid jet head for forming an image, a character, or a thin film material on a recording medium by discharging liquid from a nozzle and to a liquid jet apparatus using the same.

BACKGROUND ART

In recent years, there has been used an ink jet type liquid jet head for discharging ink droplets on recording paper or the like to render a character or graphics or for discharging a liquid material on a surface of an element substrate to form a pattern of a functional thin film. In such a liquid jet head, ink or a liquid material is supplied from a liquid tank via a supply tube to the liquid jet head, the ink is caused to fill minute space formed in the liquid jet head, and the capacity of the minute space is momentarily reduced according to a drive signal to discharge a liquid droplet from a nozzle which communicates to a groove.

FIG. 12 is an exploded perspective view of an ink jet head 50 of this type. FIG. 13A is a top view of the ink jet head 50, FIG. 13B is a sectional view taken along the line YY of FIG. 13A, and FIG. 13C is an explanatory diagram illustrating a connection structure between wiring electrodes 64 on a flexible substrate 61 and lead-out electrodes 62. The ink jet head 50 includes a piezoelectric substrate 51 having a plurality of narrow grooves 55 formed in a surface thereof, a cover plate 56 having a manifold 57 and a recessed portion 58 formed therein for supplying ink to the grooves 55, a nozzle plate 59 having nozzles 60 formed therein for discharging ink, and the flexible substrate 61 for supplying a drive signal to the piezoelectric substrate 51.

The grooves 55 are formed from a front end 52 to some midpoint between the front end 52 and a rear end 53. The plurality of grooves 55 are separated from one another by side walls 54. The nozzles 60 in the nozzle plate 59 communicate to channels formed by the grooves 55 and the cover plate 56, respectively. The side walls 54 are made of a piezoelectric material and undergo in advance polarization treatment in a vertical direction. Side wall electrodes 63 are formed on wall surfaces of the side walls 54 and are electrically connected to the lead-out electrodes 62 formed on a surface of the piezoelectric substrate 51 on the rear end 53 side. The flexible substrate 61 is bonded to a top surface of the piezoelectric substrate 51 on the rear end 53 side. This allows a drive signal generated in an external circuit (not shown) to be transmitted via the wiring electrodes 64 formed on the flexible substrate 61 and the lead-out electrodes 62 to the side wall electrodes 63 formed on the wall surfaces of the side walls 54. This may cause the side walls 54 to be subjected to shear deformation.

The ink jet head 50 is driven as follows. First, ink is supplied to the manifold 57. The ink is supplied from the manifold 57 and the recessed portion 58 to the respective grooves 55 to fill the channels formed by the cover plate 56 and the grooves 55, respectively. When a drive signal generated in an external circuit is applied via the wiring electrodes 64 formed on the flexible substrate 61 and the lead-out electrodes 62 to the side wall electrodes 63, the side walls 54 are subjected to shear deformation to reduce the capacity of the channels, thereby discharging from the nozzles 60 ink which fills the channels.

Japanese Patent Application Laid-open No. Hei 9-29977 describes an ink jet head which is similar to the above-mentioned ink jet head 50. A plurality of narrow grooves are formed in a surface of a piezoelectric ceramic substrate from a front end thereof to some midpoint between the front end and a rear end thereof, and a lid is bonded so as to cover the plurality of grooves. The lid has ink chambers formed therein for supplying ink to the plurality of grooves, respectively. Piezoelectric side walls for separating the respective grooves from one another have a conductive layer which is formed from upper edges of the side walls to bottom surfaces of the grooves. The conductive layer is routed from a front end which is on a discharge side of the piezoelectric ceramic substrate to a back surface side of the piezoelectric ceramic substrate to be connected to lead-out electrodes formed on the back surface. The plurality of lead-out electrodes on the rear surface are in the form of a fan so that the distances among the plurality of lead-out electrodes become larger from the front end to the rear end of the piezoelectric ceramic substrate. This facilitates connection between the lead-out electrodes and an external circuit.

Japanese Patent Application Laid-open No. 2000-168094 describes an ink jet head in which a plurality of recessed grooves are formed in parallel with one another in a surface of an actuator substrate formed of a piezoelectric body, top surfaces of the recessed grooves are covered with a cover plate, a nozzle plate is bonded to a front end of the actuator substrate, and a plate and a manifold member for supplying ink to a rear end are provided. Channels are formed by the plurality of recessed grooves in the actuator substrate and the cover plate which covers the top surfaces of the grooves. The channels are formed from the front end to the rear end of the actuator substrate. With regard to the plurality of channels, jetting channels for jetting liquid droplets through nozzles in a nozzle plate and dummy channels to which ink is not supplied are alternately arranged. Conductive patterns for driving are formed on wall surfaces of piezoelectric side walls for separating the grooves from one another. The conductive patterns are routed via a side surface of the actuator substrate to a back surface side thereof. This may eliminate the need for forming a rising portion having a predetermined length at the rear of the dummy channels, and the dummy channels may be made shorter, which may reduce the costs of the actuator substrate and, further, may shorten a period of jetting ink.

Japanese Patent Application Laid-open No. 2002-210955 describes an ink jet head in which an ink manifold is provided around a head chip. In the head chip, channels are formed by sandwiching side walls formed of a piezoelectric element between a lower substrate and an upper substrate, and a nozzle plate is formed at one end of the channels while a backplate having ink introduction holes formed therein for introducing ink into the channels is formed at the other end of the channels. An ink manifold member having an ink chamber and an ink flow path formed therein is provided on a rear surface of the backplate. The ink manifold member includes a top surface covering portion which extends out above the upper substrate forming the head chip.

Drive electrodes are formed on wall surfaces of side walls which form the channels, and the drive electrodes are provided so as to extend to top surfaces of the side walls. Electrodes which pierce the upper substrate and which are exposed on a surface of the upper substrate are formed at positions of the upper substrate which correspond to the channels, respectively. Further, electrodes which pierce the top surface covering portion of the ink manifold member in a thickness direction are formed at positions of the top surface covering portion of the ink manifold member which correspond to the electrodes formed in the upper substrate, the electrodes piercing the top surface covering portion being connected to wiring electrodes formed on a top surface of the top surface covering portion, and further, being routed to an outside rear surface of the ink manifold member. As a result, the drive electrodes which are formed on the side walls and are for driving the channels are connected via portions of the top surfaces of the side walls at which the drive electrodes are extendedly provided, the piercing electrodes through the upper substrate, and the piercing electrodes through the top surface covering portion to the wiring electrodes formed on the top surface covering portion and are routed to the rear surface side of the ink manifold member. This enables supply of a drive signal to the drive electrodes from the rear surface side of the ink manifold member, which may facilitate a stacked structure and may simplify a connection structure to a printer main body.

In the ink jet heads illustrated in FIG. 12 and described in Japanese Patent Application Laid-open No. Hei 9-29977, the grooves 55 forming the channels are formed from the front end to before the rear end. The grooves 55 are formed to before the rear end so as to prevent leakage of ink to the rear end side. The grooves 55 are formed by rotating at high speed a dicing blade having a grinding material embedded in an outer peripheral portion thereof, and lowering the blade by a predetermined distance into the surface of the piezoelectric substrate 51, to thereby grind the piezoelectric substrate 51 while moving the blade along the surface of the piezoelectric substrate 51. Therefore, the shape of the ends of the grooves 55 reflects the shape of a segment of a circle of the dicing blade. When the diameter of the dicing blade is 2 inches and the depth of the formed grooves 55 is 360 μm, a length X1 of slanted portions of bottom surfaces of the grooves 55 at the ends is 4 mm or more. A width X2 of the piezoelectric substrate 51 in a direction of the grooves 55 is about 10 mm, and hence the slanted portions occupy about 40% of the whole width. Further, portions of the piezoelectric substrate 51 functioning as actuators which are driven to discharge ink are mainly portions of the side walls 54 corresponding to flat bottom surfaces of the grooves 55. Portions of the side walls 54 corresponding to the above-mentioned slanted portions almost do not function as actuators, and this tendency becomes more prominent as the depth of the grooves 55 becomes smaller. The slanted portions which almost do not function as actuators occupy a considerable proportion of the whole width, which is an obstacle to miniaturization of the ink jet head 50, and to achievement of cost reduction by increasing the number of the piezoelectric substrates which can be manufactured from one wafer.

On the other hand, as described in Japanese Patent Application Laid-open No. 2000-168094 and Japanese Patent Application Laid-open No. 2002-210955, when recessed grooves are formed straight from the front end to the rear end of the surface of the piezoelectric substrate or the actuator substrate, the shape of a segment of a circle of the dicing blade is not reflected and the width of the head may be prevented from increasing due to the slanted portions of the bottom surfaces of the grooves. However, as a tradeoff, formation of the lead-out electrodes for leading to the outside the drive electrodes formed on the side walls is quite complicated. For example, in Japanese Patent Application Laid-open No. 2000-168094, in addition to formation of the recessed grooves for the dummy channels and the jetting channels, vertical grooves and divided grooves which communicate to the dummy channels are formed in the front end surface and the back surface of the actuator substrate. Further, a conductive layer is formed on the whole surface of the actuator substrate by plating or the like, and after that, an excimer laser beam is used to pattern an electrode layer on the dummy channels and an electrode layer on the front end surface, the rear end surface, and the back surface of the actuator substrate, to thereby form the lead-out electrodes. Therefore, the manufacturing method is quite complicated.

Further, in Japanese Patent Application Laid-open No. 2002-210955, the piercing electrodes corresponding to the channels are formed in the upper substrate of the head chip and are electrically connected to the drive electrodes formed on the wall surfaces of the side walls formed of the piezoelectric element, and further, the piercing electrodes corresponding to the channels are also formed in the top surface covering portion located thereabove. Therefore, the manufacturing steps are quite complicated. Further, contact between the electrodes which are formed on the top surfaces of the side walls formed of the piezoelectric element, and the electrodes which are formed in the upper substrate, and contact between the electrodes which are formed in the upper substrate, and the electrodes which are formed in the top surface covering portion are necessary. A lot of contacts are required, and thus, it is quite difficult to ensure the reliability of the contacts.

SUMMARY OF THE INVENTION

The present invention has been made in view of the above, and an object of the present invention is to provide a liquid jet head which may be manufactured by a simple method and which may be easily miniaturized.

A liquid jet head according to the present invention includes: a piezoelectric substrate including a plurality of narrow grooves formed therein from a front end to a rear end of a surface of the piezoelectric substrate, the plurality of narrow grooves being separated from one another by side walls formed of a piezoelectric body, the piezoelectric substrate having side wall electrodes for driving on wall surfaces of the side walls, and having, on a top surface thereof in proximity of rear ends of the side walls, lead-out electrodes electrically connected to the side wall electrodes; a cover plate including a manifold which communicates to the plurality of narrow grooves for supplying liquid to the plurality of narrow grooves, the cover plate being bonded to the piezoelectric substrate so as to cover a surface region from the front end to before the lead-out electrodes; and a sealing material for blocking, of channels formed by the cover plate and the plurality of narrow grooves, openings of rear channels communicating to the manifold and formed on the rear end side with respect to the manifold.

Further, the sealing material is provided at openings which are open to the manifold side of the rear channels.

Further, the sealing material is provided at openings which are open to the rear end side of the rear channels.

Further, the piezoelectric substrate has a low-permittivity substrate on which side walls formed of a high-permittivity piezoelectric body are provided upright.

Further, a liquid jet head, further includes a flexible substrate bonded to a vicinity of the rear end of the piezoelectric substrate, the flexible substrate having wiring electrodes formed thereon, which are electrically connected to the lead-out electrodes, in which: the lead-out electrodes include a first lead-out electrode provided on a top surface of one side wall of two side walls forming one of the channels and a second lead-out electrode provided on a top surface of another side wall of the two side walls, the first lead-out electrode being electrically connected to corresponding one of the side wall electrodes provided on a wall surface of the one side wall, the second lead-out electrode being electrically connected to corresponding another one of the side wall electrodes provided on a wall surface of the another side wall; and the wiring electrodes of the flexible substrate include a first wiring electrode for electrically connecting the first lead-out electrode and the second lead-out electrode.

Further, the plurality of narrow grooves are formed so that discharge channels which communicate to the manifold to discharge liquid droplets and dummy channels which do not communicate to the manifold are alternately arranged, the lead-out electrodes include a third lead-out electrode provided on a top surface of one side wall of two side walls forming one of the dummy channels and a fourth lead-out electrode provided on a top surface of another side wall of the two side walls, the third lead-out electrode being electrically connected to corresponding one of the side wall electrodes provided on a wall surface of the one side wall, the fourth lead-out electrode being electrically connected to corresponding another one of the side wall electrodes provided on a wall surface of the another side wall, and the wiring electrodes include a second wiring electrode for electrically connecting the fourth lead-out electrode provided on the top surface of the another side wall of the one of the dummy channels which is adjacent to one side of corresponding one of the discharge channels, and the third lead-out electrode provided on the top surface of the one side wall of the one of the dummy channels which is adjacent to another side of corresponding one of the discharge channels.

Further, the wiring electrodes include a common wiring electrode for electrically connecting the first lead-out electrode and the second lead-out electrode provided on top surfaces of two side walls of one of the discharge channels, and the first lead-out electrode and the second lead-out electrode provided on top surfaces of two side walls of another one of the discharge channels.

A liquid jet apparatus according to the present invention includes: the liquid jet head mentioned above; a moving mechanism for reciprocating the liquid jet head; a liquid supply tube for supplying liquid to the liquid jet head; and a liquid tank for supplying the liquid to the liquid supply tube.

A liquid jet head according to the present invention includes: a piezoelectric substrate including a plurality of narrow grooves formed therein from a front end to a rear end of a surface of the piezoelectric substrate, the plurality of narrow grooves being separated from one another by side walls formed of a piezoelectric body, the piezoelectric substrate having side wall electrodes for driving on wall surfaces of the side walls, and having, on a top surface thereof in proximity of rear ends of the side walls, lead-out electrodes electrically connected to the side wall electrodes; a cover plate including a manifold which communicates to the plurality of narrow grooves for supplying liquid to the plurality of narrow grooves, the cover plate being bonded to the piezoelectric substrate so as to cover a surface region from the front end to before the lead-out electrodes; and a sealing material for blocking, of channels formed by the cover plate and the plurality of narrow grooves, openings of rear channels communicating to the manifold and formed on the rear end side with respect to the manifold. In other words, the rear channels are sealed by the sealing material, and thus, the need for forming the slanted portions which reflect the outer shape of the dicing blade is eliminated. Thus, the width of the piezoelectric substrate in the direction of the narrow grooves may be reduced. Further, the lead-out electrodes are formed on the top surfaces of the side walls in proximity of the rear end, and thus, a structure for leading the electrodes to the outside may be simplified and the need for forming a wiring pattern through complicated steps is eliminated.

DETAILED DESCRIPTION OF THE PREFERRED EMBODIMENTS

Figure 1:
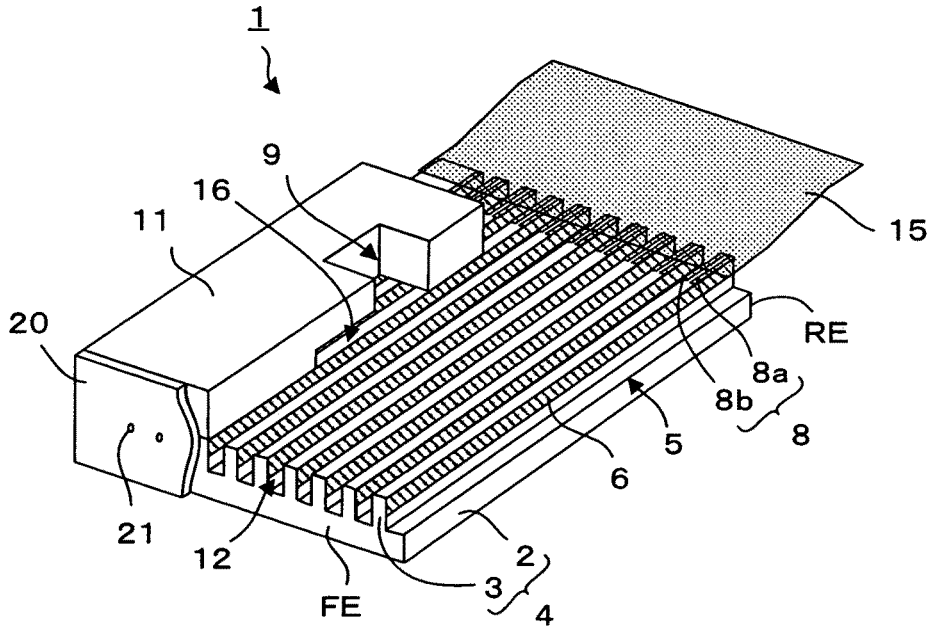
FIG. 1 is an exploded perspective view of a liquid jet head according to a first embodiment of the present invention.

A liquid jet head according to the present invention includes a piezoelectric substrate having a plurality of narrow grooves formed therein so as to be in parallel with one another from a front end to a rear end of a surface of the substrate, a cover plate which has a manifold for supplying liquid to the narrow grooves and which is bonded so as to cover a surface region from the front end to the rear end of the piezoelectric substrate and a sealing material for blocking, of channels formed by the cover plate and the narrow grooves, openings of rear channels formed on the rear end side with respect to the manifold.

Here, the plurality of grooves formed in the surface of the substrate are separated from one another by side walls formed of a piezoelectric body. Side wall electrodes for driving the side walls to be deformed are provided on wall surfaces of the side walls, and further, lead-out electrodes, which are electrically connected to the above-mentioned side wall electrodes, are provided on top surfaces of the side walls in proximity to the rear end. The cover plate is bonded to the piezoelectric substrate so as to cover the surface region from the front end of the surface of the substrate to before the lead-out electrodes, to thereby form channels.

In this way, the narrow grooves are formed straight from the front end to the rear end of the surface of the piezoelectric substrate, and thus, the need for providing slanted portions in the grooves is eliminated and the width of the piezoelectric substrate in the direction of the channels may be reduced. Further, the rear end side of the discharge channels is blocked by the sealing material, and thus, liquid to be discharged does not leak to the rear end side. In addition, the lead-out electrodes, to which a drive signal from an external circuit is input, are formed on the top surfaces of the side walls on the rear end side and are formed to be electrically connected to the side wall electrodes formed on the wall surfaces of the side walls, and thus, an electrode pattern is easily formed.

Note that, the sealing material may be provided at openings which are open to the manifold side of the rear channels, at openings which are open to the rear end side which is opposite to the manifold side, or midway between these openings. In particular, when the openings which are open to the manifold side are blocked, liquid may be prevented from accumulating in the rear channels, and hence cleaning of the flow path may be easily cleaned.

Further, a flexible substrate may be bonded to a vicinity of the rear end of the piezoelectric substrate to supply a drive signal from the outside. Wiring electrodes formed on the surface of the flexible substrate are electrically connected to the lead-out electrodes formed on the top surfaces of the side walls. Here, the lead-out electrodes include the first lead-out electrode provided on a top surface of one side wall of two side walls forming the channel and a second lead-out electrode provided on a top surface of the other side wall. The first lead-out electrode may be formed to be electrically connected to the side wall electrode provided on the wall surface of the one side wall while the second lead-out electrode may be formed to be electrically connected to the side wall electrode provided on the wall surface of the other side wall. The wiring electrodes on the flexible substrate may include a first wiring electrode for electrically connecting the first lead-out electrode and the second lead-out electrode. This may eliminate the need for connecting, on the piezoelectric substrate, the side wall electrodes formed on the wall surfaces of one side walls and the side wall electrodes formed on the wall surfaces of the other side walls which form the grooves, and steps for forming the electrodes and the electrode pattern may be simplified.

Further, the narrow grooves may be formed so that discharge channels which communicate to the manifold to discharge liquid droplets and dummy channels which do not communicate to the manifold are alternately arranged so as to be in parallel with one another. The lead-out electrodes may include a third lead-out electrode provided on a top surface of one side wall of two side walls forming the dummy channel and a fourth lead-out electrode provided on a top surface of the other side wall. Here, the third and fourth lead-out electrodes are electrically connected to the side wall electrode provided on the wall surface of the one side wall and the side wall electrode provided on the wall surface of the other side wall, respectively. Further, the wiring electrodes may include a second wiring electrode for electrically connecting the fourth lead-out electrode provided on the top surface of the other side wall of the dummy channel which is adjacent to one side of the discharge channel and a third lead-out electrode provided on the top surface of the one side wall of the dummy channel which is adjacent to the other side of the discharge channel. Further, the wiring electrodes may include a common wiring electrode for electrically connecting first and second lead-out electrodes provided on the top surfaces of two side walls of one discharge channel and first and second lead-out electrodes provided on the top surfaces of two side walls of another discharge channel.

This eliminates the need for connecting, on the piezoelectric substrate, side wall electrodes to each other, which are formed on the wall surfaces of the side walls on the discharge channel side of dummy channels located on both sides of the discharge channel, even when the discharge channels and the dummy channels are arranged alternately. This may further simplify the steps for forming the electrodes and the electrode pattern. In the following, liquid jet heads according to the present invention are specifically described with reference to the attached drawings.

First Embodiment

Figure 2A:
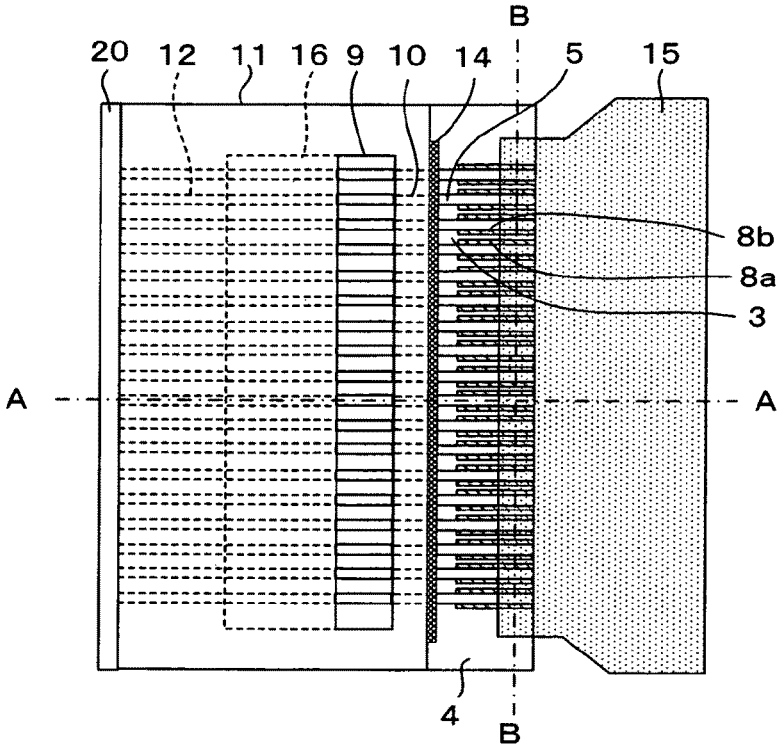
FIGS. 2A to 2C are explanatory diagrams of the liquid jet head according to the first embodiment of the present invention.
Figure 2B:
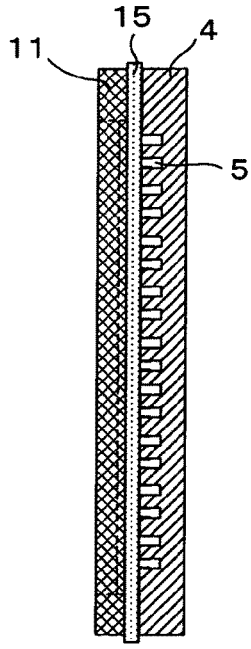
Figure 2C:
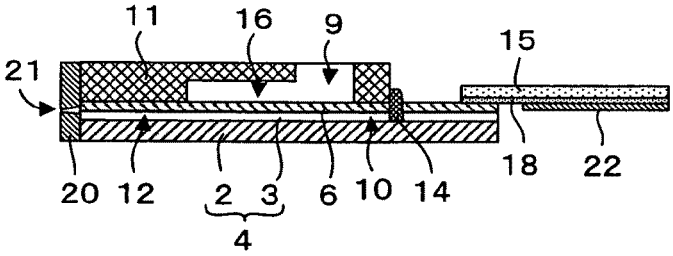

FIG. 1 is an exploded perspective view of a liquid jet head 1 according to a first embodiment of the present invention. FIG. 2A is a top view of the liquid jet head, FIG. 2B is a side view thereof, and FIG. 2C is a vertical sectional view taken along the line A-A of FIG. 2A of the liquid jet head 1. As illustrated in FIG. 1, the liquid jet head 1 includes a piezoelectric substrate 4 including a substrate 2 and side walls 3 formed on a surface thereof, a cover plate 11 bonded to a surface of the piezoelectric substrate 4, a nozzle plate 20 provided at a front end FE of the piezoelectric substrate 4, a flexible substrate 15 provided on a top surface of the piezoelectric substrate 4 in proximity to a rear end RE of the piezoelectric substrate 4, and a sealing material 14 (omitted in FIG. 1) provided at a corner formed by an end surface of the cover plate 11 on the rear end RE side and the piezoelectric substrate 4.

The piezoelectric substrate 4 includes a plurality of narrow grooves 5 which are formed in the surface thereof from the front end FE to the rear end RE and which are separated from one another by the side walls 3 formed of a piezoelectric body. Side wall electrodes 6 for driving the side walls 3 to be deformed are formed on wall surfaces of the side walls 3, respectively. Two lead-out electrodes 8*a* and 8*b* are formed on the top surface of each of the side walls 3 in proximity to the rear end RE. The lead-out electrodes 8*a* and 8*b* are electrically separated from each other at the center portion of the top surface of each of the side walls 3. The lead-out electrode 8*a* on the top surface of the side wall 3 is electrically connected to a side wall electrode 6 formed on one wall surface of the side wall 3 while the lead-out electrode 8*b* on the top surface is electrically connected to a side wall electrode 6 formed on the other wall surface of the side wall 3.

The substrate 2 and the side walls 3 of the piezoelectric substrate 4 may be made of a same piezoelectric material, for example, PZT ceramic. Alternatively, as is described below with reference to a fourth embodiment of the present invention, a low-permittivity material the permittivity of which is lower than a piezoelectric body such as a glass material or other insulating materials may be used as the substrate 2 and a piezoelectric material may be used as the side walls 3. As described above, the grooves 5 are formed straight from the front end FE to the rear end RE, and thus, the outer shape of a dicing blade is not reflected and the width of the piezoelectric substrate 4 in a direction of the grooves 5 may be reduced.

The cover plate 11 is bonded to the top surface of the piezoelectric substrate 4 with an adhesive so as to cover a region from the front end FE to before the lead-out electrodes 8. Note that, in FIG. 1, only a part of the cover plate 11 is illustrated. The cover plate 11 includes a manifold 9 and a recessed portion 16 which retain liquid to be discharged and supply the liquid to the grooves 5. A lower surface of the cover plate 11 and the grooves 5 form channels which are flow paths of the liquid. Portions of the channels which are forward of the manifold 9 are referred to as discharge channels 12 while portions of the channels which are backward of the manifold 9 are referred to as rear channels 10. A material, which is the same as that of the piezoelectric substrate 4, may be used as the cover plate 11. Using the same material may prevent warpage and peeling as the temperature changes. Alternatively, an insulating material such as glass, ceramic, or a polymeric material may be used. In this case, it is preferred that the material to be used have a thermal expansion coefficient which is similar to that of the piezoelectric substrate 4.

The sealing material 14 is applied with a dispenser to the openings of the rear channels 10 on the rear end side. This prevents leakage of the liquid via the rear channels 10 to the outside. An adhesive formed of a polymeric material or a rubber-based material may be used as the sealing material 14. It is preferred that an elastic material be used as the sealing material 14. For example, a fluorine-based elastomer may be used. If the sealing material 14 is elastic, reliability may be maintained as the environment such as the temperature changes.

The nozzle plate 20 is bonded to the front end FE of the piezoelectric substrate 4 and a front end surface of the cover plate 11 which is formed so as to be flush with the front end FE. The nozzle plate 20 includes nozzles 21 at positions which correspond to the discharge channels 12 formed by the grooves 5. A polymeric material such as a polyimide resin may be used as the nozzle plate 20. The flexible substrate 15 is bonded to the top surface of the rear end RE of the piezoelectric substrate 4 via an anisotropic conductive material (not shown). The flexible substrate 15 is a multilayer film in which wiring electrodes 18 are provided on a surface of a flexible film 17 and a protective film 22 is provided on the wiring electrodes 18, and the wiring electrodes 18 are electrically connected to the lead-out electrodes 8*a* and 8*b*, respectively.

Figure 3:
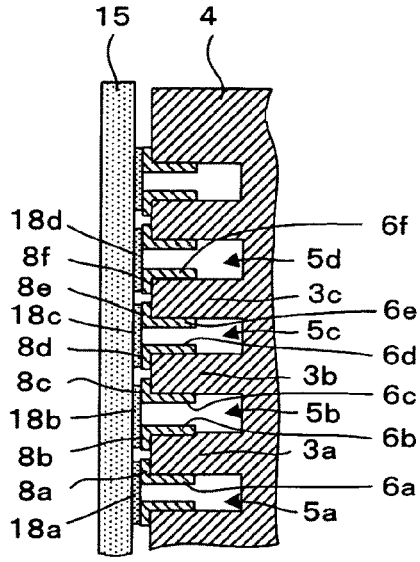
FIG. 3 is an explanatory diagram of a structure of lead-out electrodes of the liquid jet head according to the first embodiment of the present invention.

FIG. 3 is a vertical sectional view taken along the line B-B of the top view of FIG. 2A. A plurality of grooves 5*a*-5*d* are formed in the surface of the piezoelectric substrate 4. The grooves 5*a*-5*d* are separated from one another by side walls 3*a*-3*c*, respectively. A side wall electrode 6*a* is formed on one wall surface of the side wall 3*a*, a side wall electrode 6*b* is formed on the other wall surface of the side wall 3*a*, and the first lead-out electrode 8*a* electrically connected to the side wall electrode 6*a*, and the second lead-out electrode 8*b* electrically connected to the side wall electrode 6*b* are formed on the top surface of the side wall 3*a*. Similarly, a side wall electrode 6*c* is formed on one wall surface of the side wall 3*b*, a side wall electrode 6*d* is formed on the other wall surface of the side wall 3*b*, and a first lead-out electrode 8*c* electrically connected to the side wall electrode 6*c*, and a second lead-out electrode 8*d* electrically connected to the side wall electrode 6*d* are formed on the top surface of the side wall 3*b*. The side wall 3*c* and other side walls have similar electrode structure. Note that, the grooves 5*a*-5*d* correspond to discharge channels 12*a*-12*d*, respectively, which are described below.

The side wall electrodes 6*a*-6*f* on the side walls 3*a*-3*c* and the first and second lead-out electrodes 8*a*-8*f* may be simultaneously formed by depositing a metal material by oblique deposition. First, a required resist film pattern is formed on the top surfaces of the side walls 3*a*-3*c*. Then, Al, for example, is deposited obliquely from the lower-left corner of FIG. 3 to form an Al film on one wall surfaces and the top surfaces of the side walls 3*a*-3*c*. Then, Al is similarly deposited obliquely from the upper-left corner of FIG. 3 to form an Al film on the other wall surfaces and the top surfaces of the side walls 3*a*-3*c*. Note that, Al is deposited by oblique deposition, and thus, Al is not deposited on bottom surfaces of the grooves 5*a*-5*d*, which electrically separates the side wall electrodes 6*b* and 6*c* from each other and electrically separates the side wall electrodes 6*d* and 6*e* from each other. Then, the resist film is removed and an Al film pattern is formed on the top surfaces by lift-off. In this way, the electrodes may be easily formed by deposition of a metal and lift-off.

First wiring electrodes 18*a*-18*d* are formed on the piezoelectric substrate 4 side of the flexible substrate 15, which are electrically separated from one another. The first wiring electrode 18*b* electrically connects the first and second lead-out electrodes 8*c* and 8*b* which are formed on the top surfaces of the two side walls 3*b* and 3*a* of the groove 5*b*, respectively. The first wiring electrode 18*c* electrically connects the first and second lead-out electrodes 8*e* and 8*d* which are formed on the top surfaces of the two side walls 3*c* and 3*b* of the groove 5*c*, respectively, and other first wiring electrodes similarly electrically connect the first and second lead-out electrodes on side walls 3, which are adjacent to each other.

The liquid jet head 1 operates as follows. First, the manifold 9 is filled with, for example, ink as liquid, and the discharge channels 12*a*-12*d* are filled with the ink via the recessed portion 16. Then, a drive signal is supplied from the flexible substrate 15 to the piezoelectric substrate 4. For example, when the discharge channel 12*b* formed in the groove 5*b* is driven, the first wiring electrodes 18*a* and 18*c* are connected to GND and positive voltage of the drive signal is applied to the first wiring electrode 18*b*. This temporarily deforms the side wall 3*a* so as to bulge to the groove 5*a* side and deforms the side wall 3*b* so as to bulge to the groove 5*c* side. This deformation is shear deformation caused by orthogonality between a direction of polarization of the piezoelectric substrate 4 and the direction of application of the voltage. By the deformation of the two side walls 3*a* and 3*b*, the capacity of the groove 5*b* is temporarily increased, which brings about a negative pressure state in the groove 5*b*. Therefore, in order to eliminate the negative pressure state, ink is supplied via the manifold 9 and the recessed portion 16 to the groove 5*b*. The pressure of the supplied ink propagates through the groove 5*b* as a pressure wave, and reaches the nozzle 21. At the very time, the polarity of the voltage applied to the electrodes on the two side walls 3*a* and 3*b* is reversed to deform the two side walls 3*a* and 3*b* so as to bulge to the groove 5*b* side. More specifically, by applying the positive voltage of a drive signal to the first wiring electrodes 18*a* and 18*c* and connecting the first wiring electrode 18*b* to GND, the capacity of the groove 5*b* is temporarily decreased. This operation causes ink in the groove 5*b* to be pressed not only by the pressure wave of the ink, which reaches the nozzle 21, but also by the deformation of the two side walls 3*a* and 3*b*, to thereby jet from the nozzle 21 the ink which fills the groove 5*b*. This is repeatedly carried out with regard to the grooves 5*c*, 5*d*, 5*b*, . . . in this order (referred to as three-cycle drive). This may cause ink to be discharged from all the discharge channels.

Second Embodiment

Figure 4:
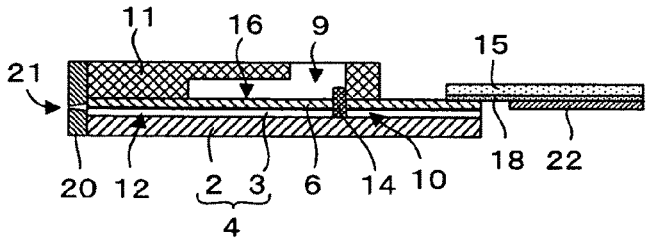
FIG. 4 is a vertical sectional view of a liquid jet head according to a second embodiment of the present invention.

FIG. 4 is a vertical sectional view of the liquid jet head 1 according to a second embodiment of the present invention. FIG. 4 is different from FIG. 2C, which illustrates the first embodiment, in that the sealing material 14 is provided at openings of the rear channels 10 which are open to the manifold 9. The rest of the structure is similar to that of the first embodiment, and therefore, description thereof is omitted.

The openings, at which the rear channels 10 communicating to the manifold 9 and the recessed portion 16 are open to the manifold 9 side, are sealed by the sealing material 14. This prevents liquid from flowing in the rear channels 10, and thus, the liquid does not accumulate in the rear channels 10. By eliminating liquid accumulation in the rear channels 10, liquid in the discharge channels 12 and the manifold 9 may be easily replaced, which can promptly remove bubbles and dust that get in the liquid. Note that, the present invention is not limited to providing the sealing material 14 on the rear end side of the rear channels 10 as in the first embodiment and providing the sealing material 14 on the manifold 9 side of the rear channels 10 as in the second embodiment, and the sealing material 14 may be provided somewhere in the rear channels 10 or in the whole rear channels 10.

Third Embodiment

Figure 5:
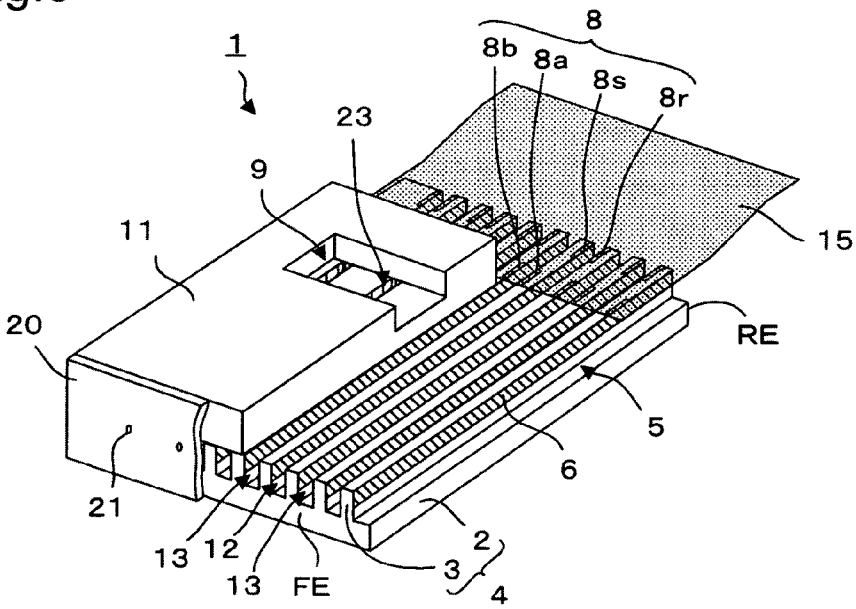
FIG. 5 is an exploded perspective view of a liquid jet head according to a third embodiment of the present invention.
Figure 6A:
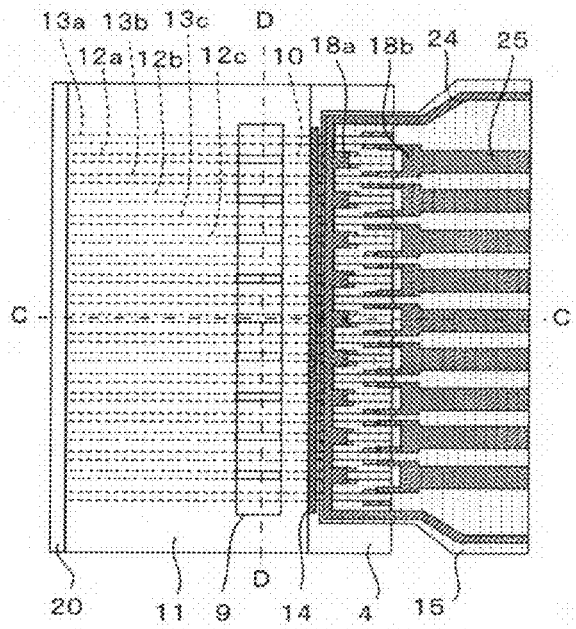
FIGS. 6A to 6C are explanatory diagrams of the liquid jet head according to the third embodiment of the present invention.
Figure 6B:
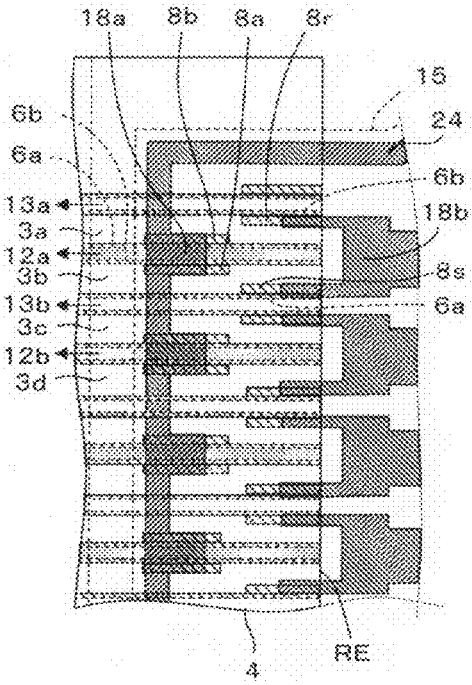
Figure 6C:
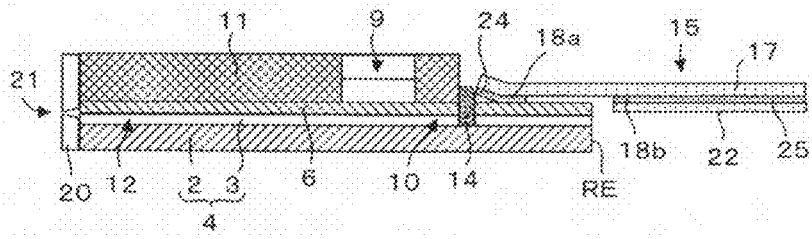
Figure 7:
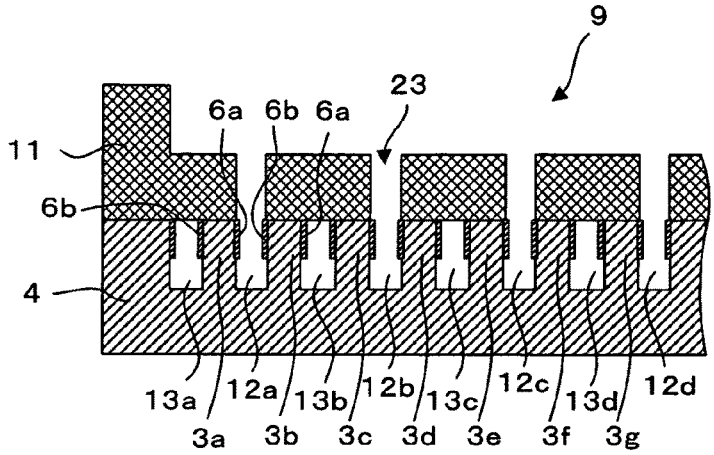
FIG. 7 is a vertical sectional view of a manifold portion of the liquid jet head according to the third embodiment of the present invention.

FIG. 5 is an exploded perspective view of a liquid jet head 1 according to a third embodiment of the present invention. FIG. 6A is a top view of the liquid jet head 1, FIG. 6B is a schematic top view illustrating a connecting state of electrodes, FIG. 6C is a vertical sectional view taken along the line C-C of FIG. 2A of the liquid jet head 1, and FIG. 7 is a partially vertical sectional view taken along the line D-D of FIG. 6A. Like reference symbols are used to designate like members or members having like functions.

As illustrated in FIG. 5 and FIGS. 6A to 6C, the liquid jet head 1 includes the piezoelectric substrate 4 having the substrate 2 and the side walls 3 formed in the surface thereof, the cover plate 11 bonded to the surface of the piezoelectric substrate 4, the nozzle plate 20 provided at the front end FE of the piezoelectric substrate 4, the flexible substrate 15 provided on the top surface of the piezoelectric substrate 4 in proximity of the rear end RE of the piezoelectric substrate 4, and the sealing material 14 provided at the corner formed by the end surface of the cover plate 11 on the rear end RE side and the piezoelectric substrate 4.

The piezoelectric substrate 4 includes the substrate 2 and the side walls 3. The plurality of narrow grooves 5 are formed on the surface of the substrate 2 so as to be separated from one another by the side walls 3. The plurality of grooves 5 are formed straight from the front end FE to the rear end RE of the substrate 2. The plurality of lead-out electrodes 8 are formed on the top surfaces on the rear end RE side of the side walls 3 for separating the plurality of grooves 5 from one another. The cover plate 11 includes the manifold 9 for supplying liquid to the grooves 5, and is bonded to the piezoelectric substrate 4 with an adhesive so as to cover the surface region from the front end FE of the piezoelectric substrate 4 to before the lead-out electrodes 8. In FIG. 5, only a part of the cover plate 11 is illustrated. Regions surrounded by the cover plate 11 and the grooves 5 in the piezoelectric substrate 4 are the channels, and the discharge channels 12 for discharging liquid and dummy channels 13 which are not filled with liquid are alternately arranged so as to be in parallel with one another.

The nozzle plate 20 is bonded and fixed to a front end of the cover plate 11 which is bonded so as to be flush with the front end FE of the substrate 2. The nozzle plate 20 includes the nozzles 21 at positions which correspond to the discharge channels 12. The flexible substrate 15 connected to an external circuit for supplying a drive signal to the piezoelectric substrate 4 is bonded to the top surface of the piezoelectric substrate 4 in proximity to the rear end RE. The materials of the substrate 2, the side walls 3, the cover plate 11, and the nozzle plate 20 and the like are similar to those of the first embodiment, and therefore, description thereof is omitted.

The manifold 9 formed in the cover plate 11 communicates to the discharge channels 12 via communication holes 23, and does not communicate to the dummy channels 13. Therefore, liquid flows in the discharge channels 12 but does not flow in the dummy channels 13. Further, the rear channels 10 are formed on the rear end RE side with respect to the manifold 9, and the sealing material 14 blocks the openings of the rear channels 10 on the rear end RE side. This prevents leakage of the liquid via the rear channels 10 to the outside or to the dummy channels 13. Note that, the nozzles 21 communicate to the above-mentioned discharge channels 12, but the nozzles 21 are not provided at positions which correspond to the dummy channels 13.

Next, an electrode structure is specifically described with reference to FIGS. 6A and 6B and FIG. 7. The first lead-out electrode 8*a* is formed on the top surface on one wall surface side of the side wall 3*b* of the two side walls 3*a* and 3*b* forming the discharge channel 12*a*, and the side wall electrode 6*b* is formed on the other wall surface of the side wall 3*b* and is electrically connected to the first lead-out electrode 8*a*. Further, the second lead-out electrode 8*b* is formed on the top surface on one wall surface side of the side wall 3*a*, and the side wall electrode 6*a* is formed on the other wall surface of the side wall 3*a* and is electrically connected to the second lead-out electrode 8*b*. The other discharge channels 12*b*-12*d* have similar electrode structure. Note that, the first lead-out electrode 8*a* and the second lead-out electrode 8*b* are provided at positions some distance from the rear end RE of the piezoelectric substrate 4. The first wiring electrode 18*a* formed on the flexible substrate 15 electrically connects the above-mentioned first lead-out electrode 8*a* and the second lead-out electrode 8*b*, and hence the first lead-out electrode 8*a* and the second lead-out electrode 8*b* are electrically connected to each other. The other discharge channels 12*b*, 12*c*, . . . have a similar electrical connection. Further, the first wiring electrode 18*a* which corresponds to the discharge channel 12*a* is electrically connected via a common wiring electrode 24 to the first wiring electrodes 18*a* which correspond to the other discharge channels 12*b*, 12*c*, . . . , respectively.

Further, a third lead-out electrode 8*r* is formed on the top surface on one wall surface side of the side wall 3*a* of the two side walls forming a dummy channel 13*a*, and the side wall electrode 6*b* is formed on the one wall surface of the side wall 3*a* and is electrically connected to the third lead-out electrode 8*r*. Further, a fourth lead-out electrode 8*s* is formed on the top surface of one wall surface side of the side wall 3*b* of the two side walls forming a dummy channel 13*b*, and the side wall electrode 6*a* is formed on the one wall surface of the side wall 3*b* and is electrically connected to the fourth lead-out electrode 8*s*. The other dummy channels 13*b*-13*d* have similar electrode structure. The third and fourth lead-out electrodes 8*r* and 8*s* provided with the discharge channel 12*a* therebetween are formed in proximity to the rear end RE of the piezoelectric substrate 4. The second wiring electrode 18*b* formed on the flexible substrate 15 electrically connects the above-mentioned third lead-out electrode 8*r* and the fourth lead-out electrode 8*s*, and hence the third and fourth lead-out electrodes 8*r* and 8*s* provided with the discharge channel 12*a* therebetween are electrically connected to each other. The other dummy channels 13*b*, 13*c*, . . . have similar electrode structure. The second wiring electrodes 18*b* are connected to individual wiring electrodes 25, respectively.

As illustrated in FIGS. 6A and 6B, the flexible substrate 15 includes the common wiring electrode 24 which is patterned along the outer periphery thereof, and the many individual wiring electrodes 25 which are provided within the common wiring electrode 24 and which are electrically separated from one another. The side wall electrodes 6*a* and 6*b* formed on the two side walls of the discharge channel 12 are shorted via the first and second lead-out electrodes 8*a* and 8*b* by the first wiring electrode 18*a* and are electrically connected to the common wiring electrode 24. Further, the dummy channels 13 are provided on both sides of the discharge channel 12, and the two side wall electrodes formed on the side walls 3 on the discharge channel 12 side of the two dummy channels 13 are shorted via the third lead-out electrode 8*r* and the fourth lead-out electrode 8*s* by the second wiring electrode 18*b*, and are electrically connected to the individual wiring electrode 25.

As illustrated in FIG. 6C, the flexible substrate 15 is bonded to the top surface of the rear end RE via an anisotropic conductive film (not shown). The flexible substrate 15 has a stacked structure including the flexible film 17, the wiring electrodes 18, and the protective film 22, and has the first wiring electrodes 18*a* at a side end of the cover plate 11 and has the common wiring electrode 24 on the outer peripheral side thereof. The common wiring electrode 24 formed on the flexible substrate 15 at the side end of the cover plate 11 is bonded so as to be isolated from the top surfaces of the side walls 3. By causing the common wiring electrode 24 to be isolated from the top surfaces of the side walls 3, the side surfaces of the side walls 3, in particular, the side wall electrodes 6 on the side walls 3 forming the dummy channels 13 are not shorted to the common wiring electrode 24. At the connections between the wiring electrodes 18 and the lead-out electrodes 8, the protective film 22 is removed to expose the first and second wiring electrodes 18*a* and 18*b*, and the first wiring electrode 18*a* is electrically connected to the first and second lead-out electrodes 8*a* and 8*b* while the second wiring electrode 18*b* is electrically connected to the third and fourth lead-out electrodes 8*r* and 8*s*.

Note that, the sealing material 14 is provided at the openings of the rear channels 10 on the rear end RE side. Instead, as described in the second embodiment, the sealing material 14 may be provided at the openings of the rear channels 10 which are open to the manifold 9 side. Alternatively, the sealing material 14 may be provided midway between the openings of the rear channels 10 on the manifold 9 side and the openings of the rear channels 10 on the rear end RE side. Further, the sealing material 14 may be provided only in the rear channels 10 which correspond to the discharge channels 12, or may be provided, in addition, in the rear channels 10 which correspond to the dummy channels 13.

Figure 8:
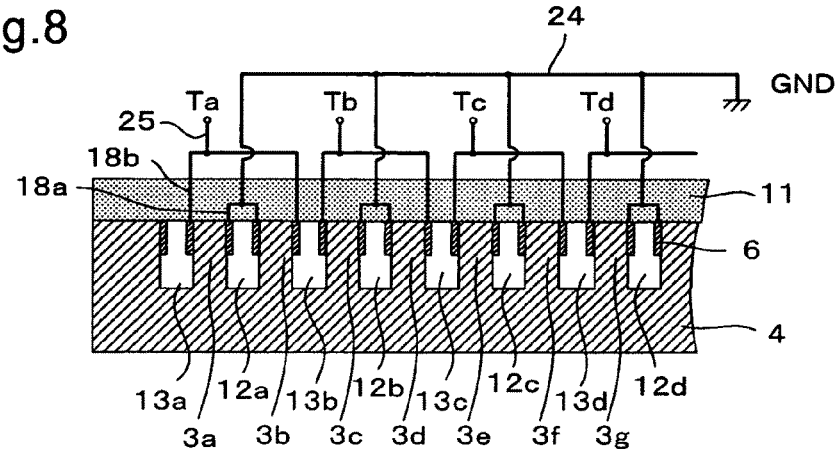
FIG. 8 is an explanatory diagram of an electrode structure of the liquid jet head according to the third embodiment of the present invention.

Next, driving operation of the third embodiment is described with reference to FIG. 8. FIG. 8 is a circuit diagram of the side wall electrodes of the discharge channels 12*a*-12*d* and the dummy channels 13*a*-13*d* which are surrounded by the side walls 3*a*-3*g* and the cover plate 11. Each of the discharge channels 12*a*-12*d* retains liquid and each of the dummy channels 13*a*-13*d* is empty. The side wall electrodes 6 provided on the two side walls 3 of the discharge channel 12 are connected via the first wiring electrode 18*a* and the common wiring electrode 24 to GND. The two side wall electrodes 6 formed on the side walls 3 on the discharge channel 12 side of the two dummy channels 13 adjacent to the discharge channel 12 are connected via the second wiring electrode 18*b* and the individual wiring electrode 25 to a terminal T.

When, for example, the discharge channel 12*a* is driven, a drive signal is applied to a terminal Ta. This temporarily deforms the side wall 3*a* so as to bulge to the dummy channel 13*a* side and deforms the side wall 3*b* so as to bulge to the dummy channel 13*b* side. This deformation is similar to the above-mentioned shear deformation. By the deformation of the two side walls 3*a* and 3*b*, the capacity of the discharge channel 12*a* is temporarily increased, which brings about a negative pressure state in the discharge channel 12*a*. Therefore, in order to eliminate the negative pressure state, liquid is supplied via the manifold 9 and the communication hole 23 to the discharge channel 12*a*. The pressure of the supplied liquid propagates through the discharge channel 12*a* as a pressure wave, and reaches a nozzle 21. At the very time, the voltage applied to the electrodes on the two side walls 3*a* and 3*b* is made to be GND to return the two side walls 3*a* and 3*b* to a flat state with no voltage applied thereto from the bulged state. More specifically, by returning the discharge channel 12*a* to the original state from the bulged state, the capacity of the groove 5*b* is temporarily decreased. This operation causes liquid in the discharge channel 12*a* to be pressed not only by the pressure wave of the liquid, which reaches the nozzle 21, but also by the deformation of the two side walls 3*a* and 3*b*, which return to the original state, to thereby jet from the nozzle the liquid which fills the discharge channel 12*a*.

When the discharge channel 12*b* is driven, a drive signal is applied to a terminal Tb. For example, when the discharge channel 12*c* is driven but the discharge channel 12*d* is not driven, even when a drive signal is applied to the side wall electrode 6 formed on the side wall on the discharge channel 12*c* side of the dummy channel 13*d* and a drive signal is not applied to the side wall electrode 6 formed on the side wall on the discharge channel 12*d* side of the dummy channel 13*d*, the dummy channel 13*d* is not filled with liquid, and thus, a drive signal does not leak between the two side wall electrodes 6. More specifically, the discharge channels 12*a*-12*d* may be simultaneously and independently driven (one-cycle drive). Further, all the discharge channels 12*a*-12*d* are in contact with the side wall electrodes 6 at the GND level, and thus, even when the liquid in the discharge channels 12*a*-12*d* is conductive, leakage of electric current is not caused.

Fourth Embodiment

Figure 9:
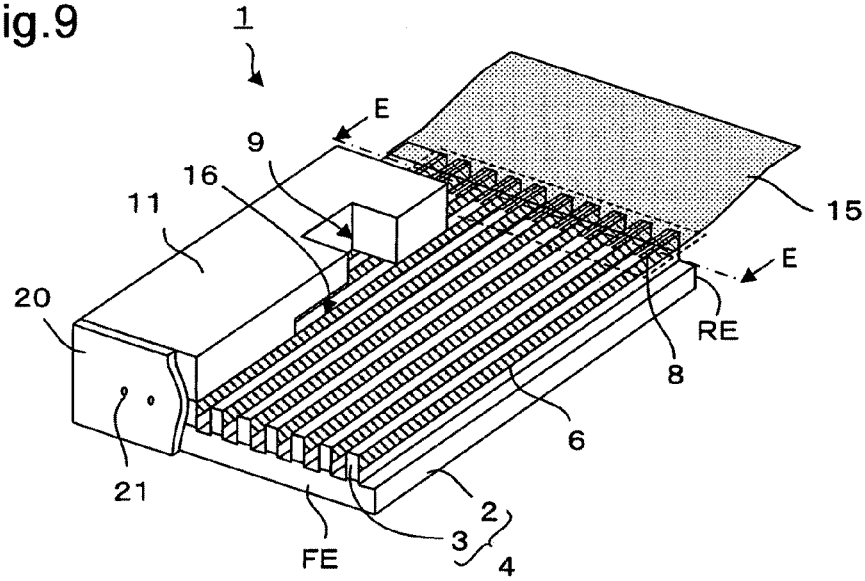
FIG. 9 is an exploded perspective view of a liquid jet head according to a fourth embodiment of the present invention.
Figure 10:
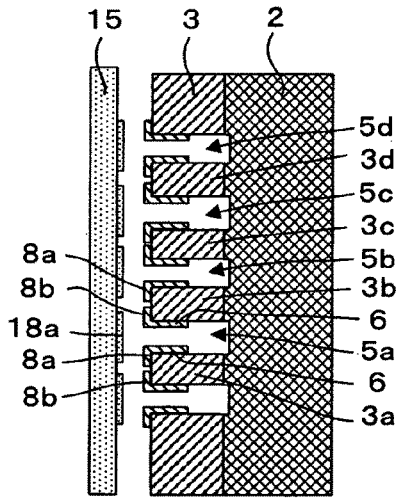
FIG. 10 is an explanatory diagram of a structure of lead-out electrodes of the liquid jet head according to the fourth embodiment of the present invention.

FIG. 9 is an exploded perspective view of the liquid jet head 1 according to a fourth embodiment of the present invention. FIG. 10 is an explanatory diagram of a structure of the lead-out electrodes taken along the line E-E of FIG. 9. The fourth embodiment is different from the first embodiment in that the material of the substrate 2 is different from the material of the side walls 3. The rest is similar to that of the first embodiment, and therefore, description thereof is omitted. Like reference symbols are used to designate like members or members having like functions.

As illustrated in FIG. 10, the side walls 3*a*, 3*b*, 3*c*, and 3*d* formed of a piezoelectric body are provided upright on the top surface of the substrate 2, and the flexible substrate 15 is bonded to the top thereof (in the figure, the flexible substrate 15 is separated for the sake of description). Each of the two side walls of each of the grooves 5*a*-5*d* has the side wall electrode 6, and each of the side walls 3*a*-3*d* has, on the top surface thereof, the first and second lead-out electrodes 8*a* and 8*b* which are electrically separated from each other. When the flexible substrate 15 is bonded to the top surfaces of the side walls 3*a*-3*d*, the first and second lead-out electrodes 8*a* and 8*b* formed on, for example, the top surfaces of the two side walls of the groove 5*a*, are electrically connected to the first wiring electrode 18*a*. The other grooves 5*b*-5*d* have similar connection structure.

A piezoelectric body is used as the side walls 3 while a low-permittivity material the permittivity of which is lower than a piezoelectric body is used as the substrate 2. A piezoelectric body layer with high permittivity and the substrate 2 with low permittivity are bonded to each other with an adhesive. A dicing blade or the like is used to perform grinding a little beyond the thickness of the piezoelectric body layer to form the grooves 5*a*-5*d*. This enables complete removal of the piezoelectric material between the side walls 3*a* and 3*b* which are adjacent to each other. A high-permittivity material such as PZT may be used as the piezoelectric material while a low-permittivity material such as glass may be used as the substrate 2. The substrate 2 is exposed at the bottom surfaces of the grooves 5. This may prevent voltage applied to, for example, the side wall electrodes 6 on the two side walls 3*a* and 3*b* of the groove 5*a* from causing malfunction, in which the voltage is transmitted via the substrate 2 to the side walls 3*c* and 3*d* by capacitive coupling to deform the side walls 3*c* and 3*d* thereby changing the capacity of the grooves 5*b* and 5*c*.

Note that, the fourth embodiment is described based on the structure of the first embodiment, but, it goes without saying that, similarly, in the second and third embodiments, a low-permittivity material may be used as the substrate 2 and a high-permittivity piezoelectric material may be used as the side walls 3.

Fifth Embodiment

Figure 11:
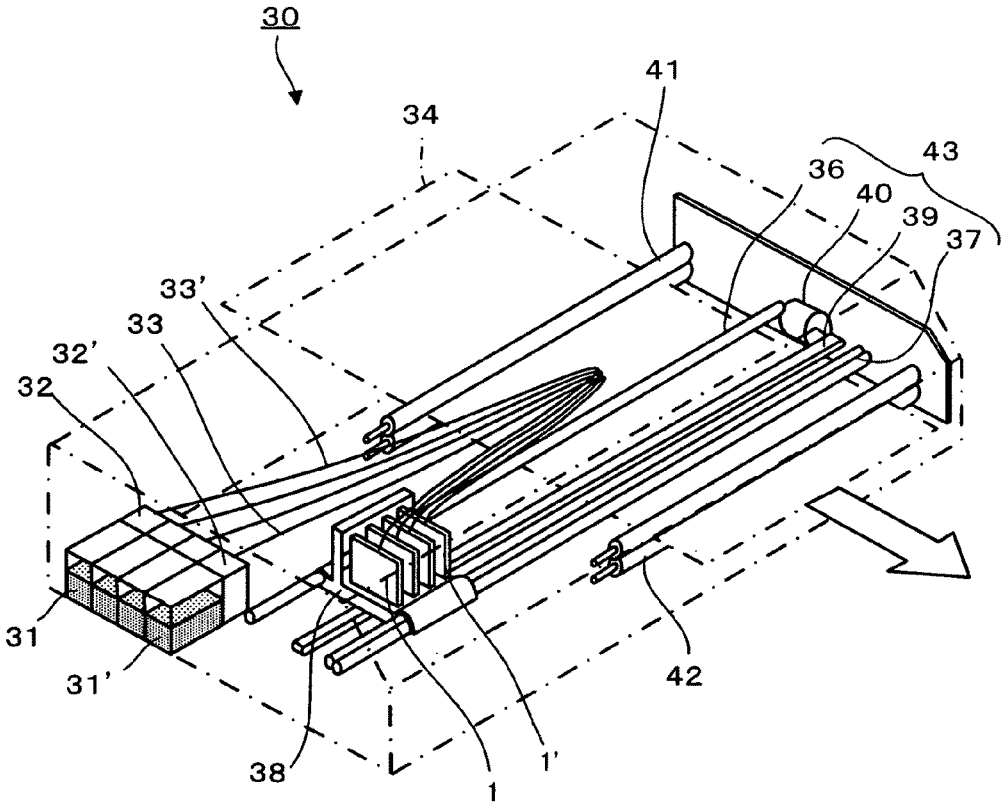
FIG. 11 is a schematic perspective view of a liquid jet apparatus according to a fifth embodiment of the present invention.
Figure 12:
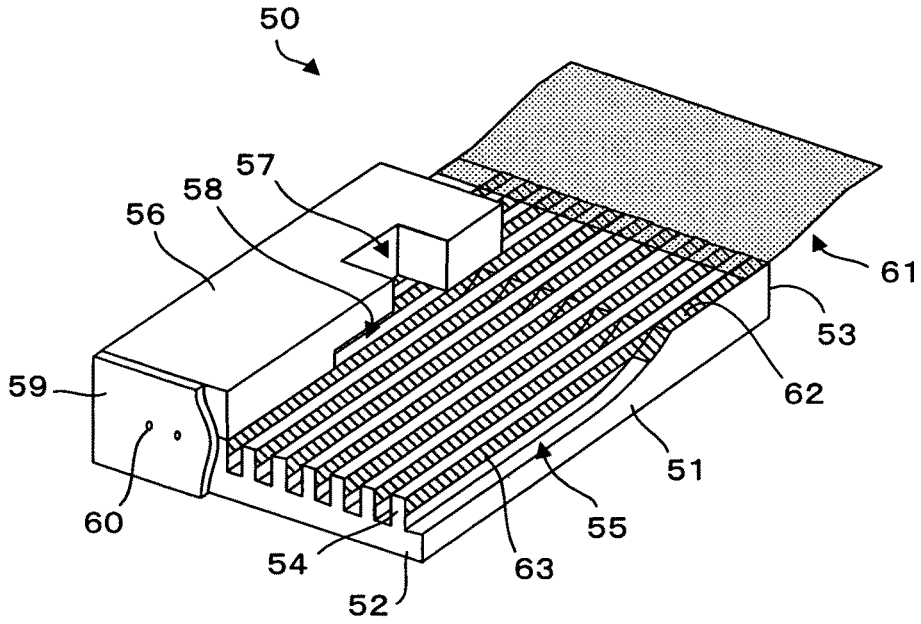
FIG. 12 is an exploded perspective view of a conventionally known ink jet head.
Figure 13A:
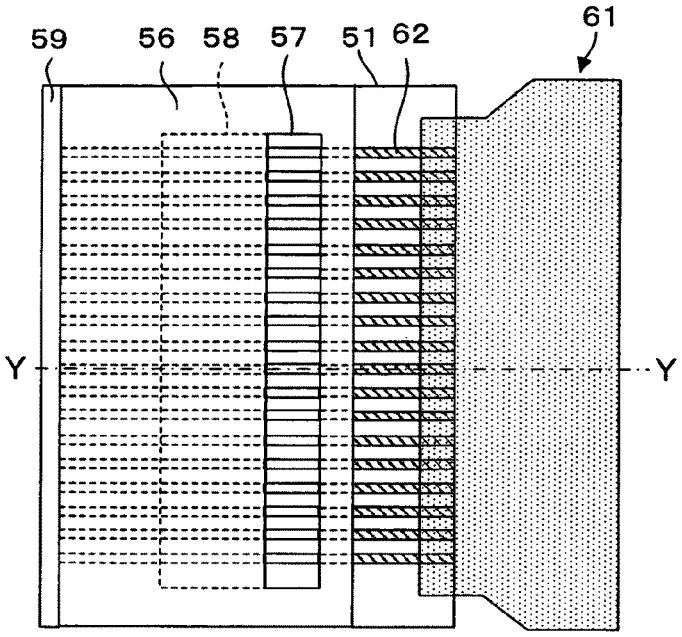
FIGS. 13A to 13C are explanatory diagrams of the conventionally known ink jet head.
Figure 13C:
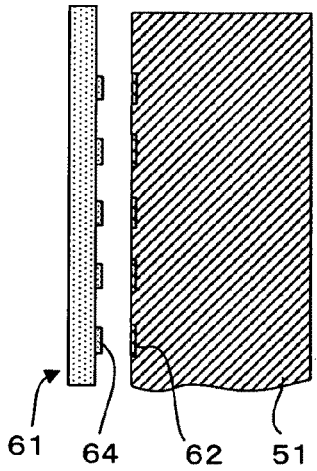
Figure 13B:
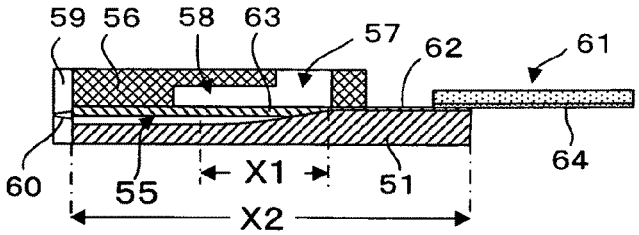

FIG. 11 is a schematic perspective view of a liquid jet apparatus 30 according to a fifth embodiment of the present invention.

The liquid jet apparatus 30 includes a moving mechanism 43 for reciprocating liquid jet heads 1 and 1' according to the present invention described above, liquid supply tubes 33 and 33' for supplying liquid to the liquid jet heads 1 and 1', and liquid tanks 31 and 31' for supplying liquid to the liquid supply tubes 33 and 33'. Each of the liquid jet heads 1 and 1' is the liquid jet head 1 according to the present invention. More specifically, each of the liquid jet heads 1 and 1' includes the piezoelectric substrate 4 having the plurality of narrow grooves 5 formed therein so as to be in parallel with one another from the front end FE to the rear end RE of the surface of the substrate, the cover plate 11 which has the manifold 9 for supplying liquid to the narrow grooves 5 and which is bonded so as to cover the surface region from the front end FE to before the rear end RE of the piezoelectric substrate 4, and the sealing material 14 for blocking, of the channels formed by the cover plate 11 and the narrow grooves 5, the openings of the rear channels 10 formed on the rear end RE side with respect to the manifold 9.

Specific description is made in the following. The liquid jet apparatus 30 includes a pair of conveying means 41 and 42 for conveying a recording medium 34 such as paper in a main scan direction, the liquid jet heads 1 and 1' for discharging liquid toward the recording medium 34, pumps 32 and 32' for pressing liquid stored in the liquid tanks 31 and 31' into the liquid supply tubes 33 and 33' for supply, and the moving mechanism 43 for causing the liquid jet head 1 to scan in an auxiliary scan direction which is orthogonal to the main scan direction.

Each of the pair of conveying means 41 and 42 includes a grid roller and a pinch roller which extend in the auxiliary scan direction and which rotate with roller surfaces thereof being in contact with each other. A motor (not shown) axially rotates the grid rollers and the pinch rollers to convey, in the main scan direction, the recording medium 34 sandwiched therebetween. The moving mechanism 43 includes a pair of guide rails 36 and 37 which extend in the auxiliary scan direction, a carriage unit 38 which is slidable along the pair of guide rails 36 and 37, an endless belt 39 which is coupled to the carriage unit 38 for moving the carriage unit 38 in the auxiliary scan direction, and a motor 40 for rotating the endless belt 39 via a pulley (not shown).

The carriage unit 38 has the plurality of liquid jet heads 1 and 1' mounted thereon for discharging, for example, four kinds of liquid droplets: yellow; magenta; cyan; and black. The liquid tanks 31 and 31' store liquid of corresponding colors, and supply the liquid via the pumps 32 and 32' and the liquid supply tubes 33 and 33' to the liquid jet heads 1 and 1'. The respective liquid jet heads 1 and 1' discharge liquid droplets of the respective colors according to a drive signal. By controlling discharge timing of liquid from the liquid jet heads 1 and 1', rotation of the motor 40 for driving the carriage unit 38, and conveying speed of the recording medium 34, an arbitrary pattern may be recorded on the recording medium 34.

The structure enables reduction of the width of the liquid jet head 1 in the direction of the narrow grooves, and thus, the formed carriage unit 38 may be compact in size. Further, it is not necessary to manufacture the liquid jet head 1 through complicated steps, which may simplify the manufacturing steps and may contribute to reduction of costs of the apparatus.

What is claimed is:

1. A liquid jet head, comprising:

a piezoelectric substrate including a plurality of narrow grooves formed therein from a front end to a rear end of a surface of the piezoelectric substrate, the plurality of narrow grooves being separated from one another by side walls formed of a piezoelectric body, the piezoelectric substrate having side wall electrodes for driving on wall surfaces of the side walls, and having, on a top surface thereof in proximity of rear ends of the side walls, lead-out electrodes electrically connected to the side wall electrodes;

a cover plate including a manifold which communicates to the plurality of narrow grooves for supplying liquid to the plurality of narrow grooves, the cover plate being bonded to the piezoelectric substrate so as to cover a surface region from the front end to before the lead-out electrodes; and a sealing material for blocking, of channels formed by the cover plate and the plurality of narrow grooves, openings of rear channels communicating to the manifold and formed on the rear end side with respect to the manifold.

2. A liquid jet head according to claim 1, wherein the sealing material is provided at openings which are open to the manifold side of the rear channels.

3. A liquid jet head according to claim 1, wherein the sealing material is provided at openings which are open to the rear end side of the rear channels.

4. A liquid jet head according to claim 1, wherein the piezoelectric substrate has a low-permittivity substrate on which side walls formed of a high-permittivity piezoelectric body are provided upright.

5. A liquid jet head according to claim 1, further comprising a flexible substrate bonded to a vicinity of the rear end of the piezoelectric substrate, the flexible substrate having wiring electrodes formed thereon, which are electrically connected to the lead-out electrodes, wherein:

the lead-out electrodes include a first lead-out electrode provided on a top surface of one side wall of two side walls forming one of the channels and a second lead-out electrode provided on a top surface of another side wall of the two side walls, the first lead-out electrode being electrically connected to corresponding one of the side wall electrodes provided on a wall surface of the one side wall, the second lead-out electrode being electrically connected to corresponding another one of the side wall electrodes provided on a wall surface of the another side wall; and the wiring electrodes of the flexible substrate include a first wiring electrode for electrically connecting the first lead-out electrode and the second lead-out electrode.

6. A liquid jet head according to claim 5, wherein:

the plurality of narrow grooves are formed so that discharge channels which communicate to the manifold to discharge liquid droplets and dummy channels which do not communicate to the manifold are alternately arranged;

the lead-out electrodes include a third lead-out electrode provided on a top surface of one side wall of two side walls forming one of the dummy channels and a fourth lead-out electrode provided on a top surface of another side wall of the two side walls, the third lead-out electrode being electrically connected to corresponding one of the side wall electrodes provided on a wall surface of the one side wall, the fourth lead-out electrode being electrically connected to corresponding another one of the side wall electrodes provided on a wall surface of the another side wall; and the wiring electrodes include a second wiring electrode for electrically connecting the fourth lead-out electrode provided on the top surface of the another side wall of the one of the dummy channels which is adjacent to one side of corresponding one of the discharge channels, and the third lead-out electrode provided on the top surface of the one side wall of the one of the dummy channels which is adjacent to another side of corresponding one of the discharge channels.

7. A liquid jet head according to claim 6, wherein the wiring electrodes include a common wiring electrode for electrically connecting the first lead-out electrode and the second lead-out electrode provided on top surfaces of two side walls of one of the discharge channels, and the first lead-out electrode and the second lead-out electrode provided on top surfaces of two side walls of another one of the discharge channels.

8. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

* * * * *